US008662564B2

(12) United States Patent
Howell et al.

(10) Patent No.: US 8,662,564 B2
(45) Date of Patent: Mar. 4, 2014

(54) PINCH-RELIEF HINGED ASSEMBLIES AND CHILDREN'S PRODUCTS INCLUDING PINCH-RELIEF HINGED ASSEMBLIES

(75) Inventors: William R. Howell, Arcade, NY (US); Charles D. Smith, East Amherst, NY (US); Jon Paul Castiglione, Orchard Park, NY (US)

(73) Assignee: Mattel, Inc., El Segundo, CA (US)

( * ) Notice: Subject to any disclaimer, the term of this patent is extended or adjusted under 35 U.S.C. 154(b) by 107 days.

(21) Appl. No.: 13/349,485

(22) Filed: Jan. 12, 2012

(65) Prior Publication Data

US 2013/0181589 A1 Jul. 18, 2013

(51) Int. Cl.
*E05D 7/00* (2006.01)

(52) U.S. Cl.
USPC ..... 296/177; 296/37.4; 49/26

(58) Field of Classification Search
USPC ..... 296/177, 37.4, 37.1; 220/847, 845, 836, 220/812, 811, 810; 446/431, 440, 465; 16/254, 260, 261, 262, 263, 265, 266, 16/267, 269, 386; 49/26
See application file for complete search history.

(56) References Cited

U.S. PATENT DOCUMENTS

| | | | | |
|---|---|---|---|---|
| 999,110 | A | 7/1911 | Humphries et al. | |
| 2,484,581 | A | 10/1949 | Pallmen | |
| 2,534,998 | A | 12/1950 | Steinbach | |
| 3,338,609 | A | 8/1967 | Banas | |
| 4,302,866 | A | 12/1981 | Irvin | |
| 4,755,159 | A | 7/1988 | Templeton et al. | |
| 4,800,620 | A | 1/1989 | Schiemann | |
| 4,824,162 | A | 4/1989 | Geisler et al. | |
| 4,913,463 | A | 4/1990 | Tlapek et al. | |
| 5,070,577 | A | 12/1991 | Bonneville et al. | |
| 5,111,503 | A | 5/1992 | Takagi | |
| 5,394,913 | A | 3/1995 | Zezza, Jr. et al. | |
| 5,570,925 | A | 11/1996 | Cohen | |
| 5,931,524 | A * | 8/1999 | Jones, Jr. | 296/177 |
| 5,947,795 | A * | 9/1999 | Cohen | 446/469 |
| 5,951,358 | A | 9/1999 | Hilko et al. | |
| 6,233,784 | B1 | 5/2001 | Daoud | |
| 6,243,919 | B1 | 6/2001 | Hetland | |
| 6,338,181 | B1 * | 1/2002 | Hwang | 16/266 |
| 6,508,320 | B2 | 1/2003 | Huntsberger et al. | |

(Continued)

FOREIGN PATENT DOCUMENTS

FR 2 571 417 4/1986

OTHER PUBLICATIONS

English-language abstract of French Patent No. 2 571 417, European Patent Office, Apr. 11, 1986.

(Continued)

*Primary Examiner* — Jason S Morrow
(74) *Attorney, Agent, or Firm* — DASCENZO Intellectual Property Law, P.C.

(57) ABSTRACT

Hinged assemblies, and children's products including at least one hinged assembly, include a base member and a hinged member operatively and pivotally coupled to the base member to define a hinge. The hinge is configured to release if an obstruction is positioned between the hinged member and the base member while the hinged member is being closed and if a closing torque is greater than or equal to a release torque. The hinge also may be configured to not release when an opening torque is applied when the hinged member is in its open position even when the opening torque is greater than the release torque.

21 Claims, 4 Drawing Sheets

(56) References Cited

U.S. PATENT DOCUMENTS

| | | | | |
|---|---|---|---|---|
| 6,779,434 | B2 | 8/2004 | Hsu | |
| 6,918,508 | B2 * | 7/2005 | Hwang | 220/826 |
| 7,013,530 | B2 | 3/2006 | Lallemant | |
| 7,080,754 | B2 | 7/2006 | Lown | |
| 7,195,271 | B2 | 3/2007 | Howell et al. | |
| 7,722,068 | B2 | 5/2010 | Michelau | |
| 7,870,972 | B2 | 1/2011 | Elefante | |
| 2008/0237252 | A1 * | 10/2008 | Elefante | 220/811 |
| 2011/0088224 | A1 | 4/2011 | Bell | |
| 2011/0121605 | A1 * | 5/2011 | Ruby et al. | 296/146.9 |

OTHER PUBLICATIONS

Tek Nek, "Sesame Fly with Elmo Ride-On," Oct. 2007. Cited in International Search Report issued Apr. 2, 2013 for PCT Patent Application No. PCT/US2013/021148, 8 pages.

* cited by examiner

PINCH-RELIEF HINGED ASSEMBLIES AND CHILDREN'S PRODUCTS INCLUDING PINCH-RELIEF HINGED ASSEMBLIES

FIELD

The present application relates to pinch-relief hinges and to children's products that include pinch-relief hinges.

BACKGROUND

Children's products come in many shapes and forms and include such products as toys, toy vehicles, children's ride-on vehicles, play sets, play structures, toy tracks, toy chests, etc. Often such children's products include hinged structure, such as associated with a cavity having a corresponding closure. Illustrative, non-exclusive examples of hinged structures include structures that are associated with hoods, trunks, and doors of children's ride-on vehicles and other toy vehicles, hinged covers for toy chests, hinged doors, windows, and gates of toy play structures, hinged track sets, and the like.

When a children's product includes a hinged structure, it is desirable for the structure to incorporate some form of pinch-relief functionality, that is, functionality that serves to restrict or prevent a child's finger (or other body part) or any other obstruction from being pinched by the hinged structure. Moreover, it may be desirable that the pinch-relief functionality of a children's product not facilitate breakage, or other damage, of the children's product. That is, it may be desirable for a hinged structure to prevent the pinching of a child or other obstruction without the hinged structure or other portion of the children's product having to break to prevent the pinching.

SUMMARY

Hinged assemblies according to the present disclosure include a base member and a hinged member operatively and pivotally coupled to the base member to define a hinge. The hinge is configured to release if an obstruction is positioned between the hinged member and the base member while the hinged member is being closed and if a closing torque is greater than or equal to a release torque. In some embodiments, the hinge is configured to not release when an opening torque is applied when the hinged member is in its open position even when the opening torque is greater than the release torque. Children's products, including children's ride-on vehicles, that include hinged assemblies also are disclosed and within the scope of the present disclosure.

DETAILED DESCRIPTION

Figure 1:
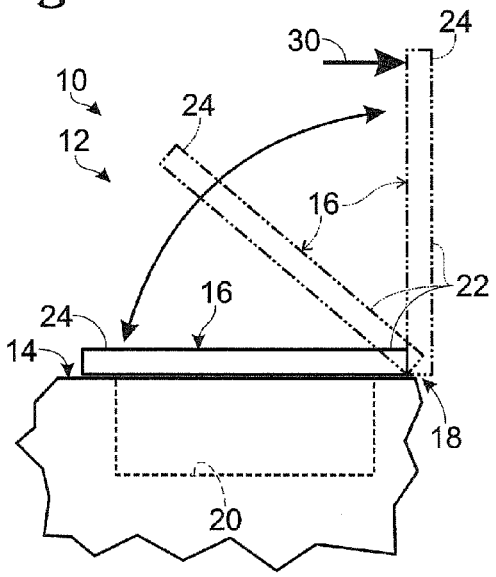
FIG. 1 is a diagram schematically representing illustrative, non-exclusive examples of hinged assemblies and children's products according to the present disclosure.
Figure 2:
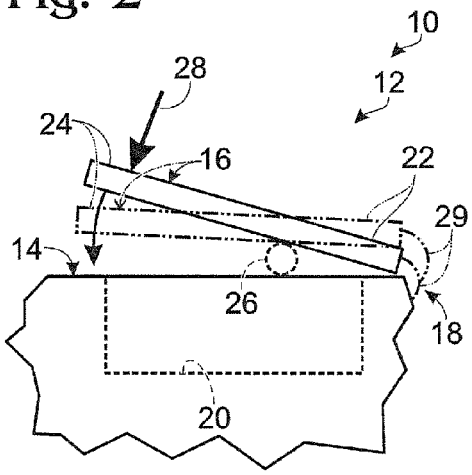
FIG. 2 is another diagram schematically representing illustrative, non-exclusive examples of hinged assemblies and children's products according to the present disclosure.
Figure 3:
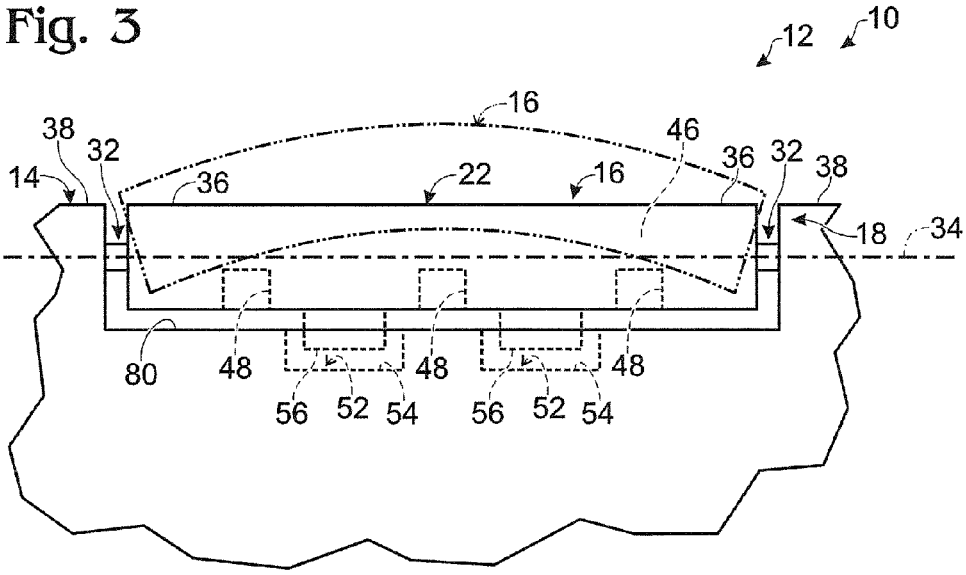
FIG. 3 is another diagram schematically representing illustrative, non-exclusive examples of hinged assemblies and children's products according to the present disclosure.

Children's products and hinged assemblies according to the present disclosure are schematically illustrated in FIGS. 1-3 and are indicated generally at 10 and 12, respectively. Children's products 10 may take any suitable form and may represent any type of children's product that includes a hinged assembly. Illustrative, non-exclusive examples of children's products that may include, incorporate, and/or define a hinged assembly 12 include (but are not limited to) toys, toy vehicles, children's ride-on vehicles, battery-powered children's ride-on vehicles, play sets, toy play structures, toy tracks, toy chests, children's furniture, children's storage chests, high chairs, toy ovens, etc.

Hinged assemblies 12 include a base member 14 and a hinged member 16 that is operatively and pivotally coupled to the base member. The base member and the hinged member collectively define a hinge 18. As discussed in more detail herein, hinge 18 may be configured to enable pivotal movement between the base member and the hinged member within a range of positions, such as between a closed position and a fully open position. In some embodiments, the hinge may be a distinct structure that is fastened or otherwise coupled to corresponding portions of the children's product 10 to pivotally (and releasably) couple these portions together. In such an embodiment, hinge 18 may be described as being a separate structure from the corresponding portions of the children's product that it pivotally couples together. However, this construction is not required to all embodiments, as it is also within the scope of the present disclosure that hinge 18 may not be a distinct structure that is separate and apart from the portions of the children's product that it couples together. In other words, in some embodiments, the base member and/or hinged member that form hinge 18 may be structural portions of the children's product and not simply a separate accessory that is fastened to portions of the children's product, as is the case with many conventional door and closure hinges.

As schematically illustrated in FIGS. 1 and 2, base member 14 in some embodiments optionally may define a cavity 20 that is selectively covered and uncovered by the hinged member, but such a configuration is not required. As illustrative, non-exclusive examples, the base member may be, may include, and/or may be defined by a toy-vehicle body, and the hinged member may be, may include, and/or may be defined by a hood, a trunk closure, a seat, a battery compartment closure, and/or a door. Other configurations are within the scope of the present disclosure, and hinged assemblies 12 are not limited to being used with toy vehicles. As a further illustrative, non-exclusive example, toy and/or children's play sets and/or play structures may include a base member 14, such as in the form of a reduced-scale house, building, barn, vehicle, airplane, space craft, etc., with at least one hinged assembly 12 that pivotally and detachably couples a hinged member 16 thereto, with the hinged member taking the form of such illustrative, non-exclusive forms as a door, gate, window, lid, storage cover, case, lid, etc.

Hinged member 16 includes a proximal end region 22 that is operatively coupled to the base member in a pivotal relationship, as schematically illustrated in FIG. 1, and a distal end region 24 that is opposite the proximal end region. The proximal end region additionally or alternatively may be described as the hinged end 22 of the hinged member, and the distal end region additionally or alternatively may be described as the non-hinged end 24 of the hinged member. In FIG. 1, the hinged member is illustrated schematically in solid lines in a closed position, and in partially open and fully open positions in dash-dot-dot lines, thereby schematically representing that the hinged member is selectively pivotal relative to the base member in a range of positions, as represented by the double arcuate arrow. In some embodiments, the fully open position is defined by the structure of the hinge, such as by one or more portions of the hinged member and/or the base member. In other words, in some embodiments, the hinged structure itself may define the fully open position of the hinged assembly, such as by engagement of one of more portions of the hinged member and/or the base member engaging each other and/or adjacent portions of the corresponding children's product.

When the hinged member is in the closed position, its distal end region is adjacent to the base member, and when the hinged member is in an open position, its distal end region is spaced further away from the base member than when it is in the closed position, or at least farther away from the portion of the base member to which the distal end region is adjacent when in the closed position.

With reference to the schematic illustration of FIG. 2, hinge 18 may be configured so that if an obstacle 26 (such as a child's finger or hand) is placed, or positioned, between hinged member 16 and base member 14 when the hinged member is being closed, the proximal end region 22 of the hinged member will disengage from the base member under certain circumstances, so as to restrict or prevent pinching of the obstacle. As illustrative, non-exclusive examples, an obstacle that may facilitate the disengagement between the hinged member from the base member may have a diameter, an outer dimension, and/or otherwise a dimension that generally defines a distance between contact points of the obstacle with the base member and the hinged member that is in the range of 5-60 millimeters (mm), that is at least 5, 10, 15, 20, 25, 30, 35, 40, 45, 55, or 60 mm, and/or that is less than 60, 55, 50, 45, 40, 35, 30, 25, 20, 15, or 10 mm. Dimensions of obstacles greater than, less than, and within the various enumerated ranges are within the scope of the present disclosure.

The disengagement of the hinged member from the base member may additionally or alternatively be described herein as the separation of the hinged member from the base member, the detachment of the hinged member from the base member, the decoupling of the hinged member from the base member, the release of the hinge, the release of the hinged assembly, the hinge release, the hinged assembly release, and/or simply as the release. This release occurs if a closing force creates a closing torque that is greater than or equal to a release torque. In other words, there is a minimum torque (that is, the release torque) required to be applied to the hinged member in the direction of the curved arrow in FIG. 2 in order for the proximal end region of the hinged member to become disengaged from the base member. Stated differently, the structure of the hinged assembly effectively defines the release torque, which if applied to the hinged member, causes it to release from the base member.

In FIG. 2, the closing force is schematically represented by the arrow indicated at 28, and will create a closing torque that is or at least approximately is equal to the closing force multiplied times the distance between the force and the point of contact between the hinged member and the obstruction. If a closing torque that is less than the release torque is applied to the hinged member, even when on obstacle obstructs closing of the hinged member, the proximal end region of the hinged member will not become disengaged from the base member.

The term "torque" additionally or alternatively may be referred to as a moment or as a moment of force and, as mentioned, relates to the product (multiplication) of a force and a distance along a lever from a fulcrum at which point the force is applied to the lever. In the example of a hinged assembly 12, the hinged member is the lever and the obstacle is the fulcrum.

In FIG. 2, the hinged member is illustrated in dash-dot-dot lines with its proximal end region spaced away from the base member, schematically representing the functionality of hinge 18 when an obstacle obstructs closing of the hinged member and when closing force 28 creates a closing torque that is greater than the release torque associated with the hinge. A hinged assembly 12 and hinge 18 may be configured with a selected release torque based at least in part on such illustrative, non-exclusive criteria as the type of children's product incorporating a hinge 18, the appropriate age range associated with the children's product, and/or the specific structure associated with a children's product and incorporating a hinge 18. Illustrative, non-exclusive examples of suitable release torques include (but are not limited to) torques of at least 0.1, 0.2, 0.5, 1, or 2 newton meter (N·m), torques in the range of 0.1-2, 0.1-1, 0.1-0.5, 0.1-0.2, 0.2-2, 0.2-1, 0.2-0.5, 0.5-2, 0.5-1, or 1-2 N·m. Release torques that are less than, greater than, and within the enumerated values and ranges are within the scope of the present disclosure. The release torque to be used for a particular hinged assembly may vary according to one or more of a variety of factors, illustrative, non-exclusive examples of which include the size of the base member, the hinged member, and/or the hinged assembly, the materials of construction of the base member, the hinged member, and/or the hinged assembly, the intended age of user of the children's product, design preferences, desired tolerances, etc.

In some embodiments, when the hinged member disengages from the base member in response to an opening torque being greater than or equal to the release torque, and when an obstacle is positioned between the hinged member and the base member, one or both of the hinged member and the base member may not be damaged. In other words, the hinge may be specifically configured, adapted, and/or designed so that the release of the hinge does not damage the hinged assembly and/or the children's product. Additionally or alternatively, in some embodiments, the hinged member and the base member may be configured to be repeatedly disengaged from each other and reengaged with each other to define the hinge without damage to the hinged member or the base member. In other words, the hinge may be specifically configured, adapted, and/or designed so that the hinge may be repeatedly released and put back together by a user.

FIG. 2 also schematically illustrates an optional tether 29, which may be provided to tether the hinged member to the base member, for example, even when the hinge is released and the proximal end region 22 has disengaged from the base member. Accordingly, while the hinged member is described herein as being configured to become disengaged from the base member, such a description refers to the engagement that defines hinge 18. In some embodiments, in which an optional tether is included, the hinged member may remain connected, or coupled, to the base member even when the hinge is released due to a closing torque greater than or equal to the release torque being applied when an obstacle is positioned between the hinged member and the base member. In other words, herein when the hinged member, or a portion or component thereof, is described as disengaging from the base member, the hinged member may not be completely disconnected from the base member, in so far as an optional tether may be utilized. A tether may be provided, for example, to prevent the hinged member from becoming lost upon disengaging from the base member. Additionally or alternatively, a tether may be provided so that the hinged member does not risk breaking when it is disengaged from the base member, and a child otherwise is not taking care to prevent the hinged member from breaking.

Hinge 18 additionally or alternatively may be configured so that the opening of hinged member 16 relative to base member 14 will not cause the hinged member to disengage from the base member. For example, with reference to the schematic illustration of FIG. 1, an opening force is schematically represented by an arrow at 30. When the hinged member is in a fully open position and when opening force 30 creates an opening torque that is less than a maximum opening torque, the hinge member may not become disengaged from the base member, and the hinge therefore may not release. The opening torque is defined by the product (multiplication) of the opening force and the distance generally from the application of the opening force to the proximal end region of the hinged member, which acts as a fulcrum.

While the fully open position is illustrated schematically in FIG. 1 as being approximately ninety degrees from the illustrated closed position, such a configuration is not required, and hinged assemblies 12 and/or hinges 18 may define any suitable range of positions for a hinged member relative to a base member, for example, depending on the particular children's product incorporating a hinged assembly 12. When an opening torque that is greater than the maximum opening torque is applied to the hinged member when it is in its fully open position, the hinged member may disengage from the base member. Additionally or alternatively, in some embodiments, when an opening torque is greater than the maximum opening torque, the hinge, the hinged assembly, and/or the children's product may break.

In some embodiments, hinge 18 may be configured such that the maximum opening torque is greater than the release torque. Stated differently, the hinge may be configured to release when a closing torque is equal to the release torque and when there is an obstacle between the hinged member and the base member, but to not release when an opening torque is equal to the release torque and less than the maximum opening torque when the hinged member is in its fully open position.

In some embodiments, the maximum opening torque may be substantially greater than the release torque. In other words, it may be easy to cause the hinge to release when an obstacle is present and when closing the hinged member, but it may be difficult to cause the hinge to release and/or break when opening the hinged member. In some embodiments, the maximum opening torque may be at least twice as great as the release torque. In some embodiments, the maximum opening torque may be at least five or at least ten times as great as the release torque. Other ratios of the maximum opening torque to the release torque also are within the scope of the present disclosure, including ratios that are less than and greater than the enumerated ratios herein.

Turning now to FIG. 3, base member 14 and hinged member 16 are schematically illustrated as being operatively coupled to each other by a pair of coupling structures 32, with the coupling structures defining an axis 34, about which the hinged member is pivotal relative to the base member. In some embodiments, the hinged member may be described as including a pair of opposed hinged-member end-regions 36, and the base member may be described as including a pair of opposed base-member hinge-regions 38 that are configured to selectively mate with the opposed hinged-member end-regions, and that are mated with the opposed hinged-member end-regions when the hinged member and the base member are operatively coupled to define hinge 18. In other words, the opposed hinged-member end-regions and the opposed base-member hinge-regions may be described as collectively defining hinge 18 and axis 34. Additionally or alternatively, the opposed hinged-member end-regions and the opposed base-member hinge-regions may be described as collectively defining coupling structures 32.

Figure 4:
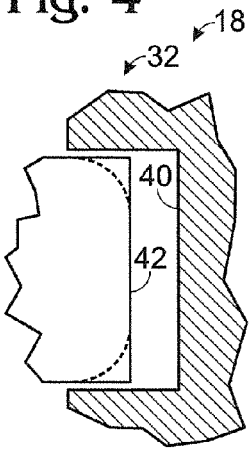
FIG. 4 is a diagram, partially in cross-section, schematically representing illustrative, non-exclusive examples of coupling structures of hinged assemblies according to the present disclosure.

Coupling structure 32 may take any suitable form, illustrative, non-exclusive examples of which include sockets 40 and corresponding protrusions 42 that are received in and pivotal within the sockets, as schematically illustrated in FIG. 4. In some embodiments, the hinged member may include a pair of sockets, and the base member may include a pair of protrusions that mate with the sockets. Alternatively, the base member may include a pair of protrusions, and the hinged member may include a pair of sockets. In some embodiments, the hinged member may include one protrusion and one socket, and the base member also may include one protrusion and one socket, with the base member's protrusion and socket being configured for selective mating with the hinged member's socket and protrusion, respectively. Protrusions additionally or alternatively may be described as pins, arms, ears, projections, nubbins, and/or as any other suitable structure configured to selectively mate with a corresponding socket. Additionally or alternatively, sockets may be described as pockets, as receivers, as dimples, as recesses, or as any other suitable structure configured to selectively mate with a corresponding protrusion.

Figure 5:
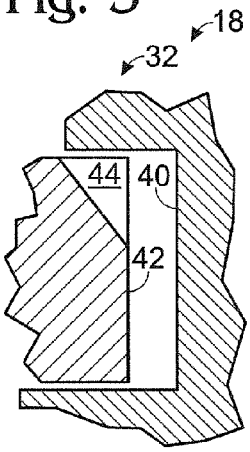
FIG. 5 is another diagram schematically representing in cross-section illustrative, non-exclusive examples of coupling structures of hinged assemblies according to the present disclosure.

Various configurations of protrusions 42 and sockets 40 are within the scope of the present disclosure, with illustrative, non-exclusive examples schematically illustrated in FIGS. 4-5. For example, as illustrated in dashed lines in FIG. 4, a protrusion may be generally rounded, or may include a chamfer or bevel around all or a subportion of the circumference of the protrusion. Such a configuration may facilitate the release of hinge 18, such as by facilitating the disengagement of the protrusion from the socket, for example, due to the area of the contact between the protrusion and the socket. The tolerance, or spacing, between the protrusion and the socket also may facilitate the release of the hinge. Accordingly, the configurations of the protrusion and the socket may at least in part determine the release torque associated with the hinge.

Additionally or alternatively, protrusions 42 and/or sockets 40 may be configured so that the release torque associated with a hinge 18 varies depending on the pivotal position of the hinged member relative to the base member. For example, in some circumstances, it may be desirable for the hinge to release more easily when the hinged member is obstructed when the hinged member is generally near its closed position. Similarly, it may be desirable for the hinge to not release or to release only with a greater closing torque when the hinged member is obstructed when the hinged member is generally near the open position. For example, the size of a child's finger may correspond to only a fraction of the pivotal movement of the hinged member relative to the base member, for example, corresponding to less than 30, less than 20, or less than 10 degrees of pivotal movement of the hinged member. Accordingly, it may be desirable for the hinge to release only when an obstacle approximately the size of a child's finger obstructs the hinged member from closing. Such a configuration may be described as defining release torques that are greater toward the open position of the hinged member than toward the closed position of the hinged member. Additionally or alternatively, such a configuration may be described in terms of the corresponding closing torque. For example, the closing torque required to cause the hinge to release may be greater when the hinged member is closer to its open position than its closed position.

FIG. 5 schematically illustrates in cross-section illustrative, non-exclusive examples of a coupling structure configuration that may be used to facilitate a hinge having a greater release torque when the hinged member is toward its open position or within another desired range of positions. Specifically, protrusion 42 may not be uniform, with the schematically illustrated example representing a protrusion having a chamfer, or bevel, 44 that extends less than the entire circumference of the protrusion, such as according to a desired angle or range of release, or fraction of the pivotal movement for which easier release of the hinge is desired. For example, the bevel may correspond to less than 30, less than 20, or less than 10 degrees of the circumference of the protrusion. Moreover, socket 40 also may not be uniform about its circumference, such as schematically illustrated in FIG. 5 in cross-section with the socket engaging more of the protrusion at its bottom than at its top. Accordingly, when the protrusion is in the schematically illustrated position, the required release torque may be less than if the protrusion were rotated 90 or 180 degrees from the schematically illustrated position. For example, in the illustrated position, less of the protrusion is engaged with the socket than if bevel 44 were positioned adjacent the lower portion of the socket where it extends further over the protrusion.

Hinges that include configurations that define a limited range of release and/or that define a range of pivoting of the hinged member in which the release torque is less than another range of pivoting may be described as being keyed, or as being keyed for a desired release profile.

Referring back to FIG. 3, and as represented by dash-dot-dot lines, hinged member 16 additionally or alternatively may have a flexibility that operatively permits, enables, or otherwise facilitates hinge 18 to release. That is, the flexibility of the hinged member may permit opposed hinged-member end-regions 36 to disengage from opposed base-member hinge-regions 38, for example, when a closing force 28 creates a closing torque that is greater than the release torque when the hinged member is being closed and an obstruction is present between the hinged member and the base member. In other words, hinge 18 may be configured so that the hinged member flexes, bows, or otherwise bends or deforms in response to something obstructing the closing of the hinged member, and the flexing of the hinged member may cause the hinged member to disengage from the base member. In some embodiments, the flexing of the hinged member may facilitate the disengagement of only one of the opposed hinged-member end-regions from the corresponding base-member hinge-regions. For example, in some circumstances, an obstacle may be positioned closed to one side of the hinged member, and the flexibility of the hinged member may not uniformly affect both of the opposed hinged-member end-regions with respect to the corresponding opposed base-member hinge-regions. In some circumstances, upon the disengagement, or release, of one end of the hinge, the other end of the hinge also may disengage, or release, simply due to gravity, due to the closing force, etc., and not necessarily directly due to the flexing of the second-to-disengage end-region.

Additionally or alternatively, in some embodiments, the hinged member may be described as defining or as including an axle 46 that includes the proximal end region 22 and opposed hinged-member end-regions 36 and that extends between opposed base-member hinge-regions 38 when the hinged member is operatively coupled to the base member. In some such embodiments, the axle may be described as including a flexibility that operatively permits the opposed hinged-member end-regions to disengage from the opposed base-member hinge-regions, for example, when a closing force 28 creates a closing torque that is greater than the release torque when the hinged member is being closed and an obstruction is present between the hinged member and the base member. In other words, hinge 18 may be constructed so that the axle flexes, bows, or otherwise bends in response to something obstructing the closing of the hinged member, and the flexing of the axle may cause the hinged member to disengage from the base member.

As schematically illustrated in FIG. 3, some embodiments of hinged members 16 may include an axle 46 that defines one or more voids, or void regions, 48 between opposed hinged-member end-regions 36. The one or more voids, when present, may facilitate the flexibility of the axle. While three optional voids are illustrated schematically in FIG. 3, any number of voids may be defined, including zero voids, one void, two voids, and more than three voids. Voids 48 additionally or alternatively may be described as cut-outs, bend points or regions, areas of reduced cross-section, etc., depending on the configuration and construction of an axle incorporated into a hinged assembly 12.

Placement of the optional voids may affect the configuration of the flexibility of the axle. For example, having voids spaced across (and optionally generally regularly across) the width of the axle may facilitate a somewhat uniform flexing of the axle, with the axle generally defining a regular or uniform arc, as schematically represented in dash-dot-dot lines in FIG. 3. Additionally or alternatively, placement of a void close to or within an opposed hinged-member end-region 36 may facilitate only the end region of the axle flexing, or at least flexing to a greater degree than the remainder or other portions of the axle. For example, in some embodiments, an axle may include two voids, with each void being positioned adjacent to or within the opposed hinged-member end-regions, so that when an obstacle is between the hinged member and the base member and a closing force is applied to the hinged member, the end regions of the axle flex, bow, or otherwise bend, whereas the body, or remainder, of the axle between the end regions may not flex at all or at least may flex less than the end-regions of the axle. Other configurations also are within the scope of the present disclosure.

Additionally or alternatively, in some embodiments, axle 46 may be generally cylindrical in shape. In some embodiments, the axle may define generally a hollow cylinder, and in some embodiments, the axle may define a generally hollow open cylinder, or channel. Other configurations of axles also are within the scope of the present disclosure, including axles that do not have a cylindrical or generally cylindrical shape.

As mentioned, hinge 18 may be configured so that the opening of hinged member 16 relative to base member 14 will not cause the hinged member to disengage from the base member. Such a configuration may be facilitated at least in part by the keyed configuration discussed herein. Additionally or alternatively, in embodiments that include a flexible hinged member and/or a flexible axle, the hinged assembly may include structure that restricts the flexing of the hinged member when it is in its fully open position. As an illustrative, non-exclusive example, such structure may effectively transfer the opening force 30 from the hinged member to the base member without flexing, or while minimizing the flexing of, the hinged member and/or its axle.

Figure 6:
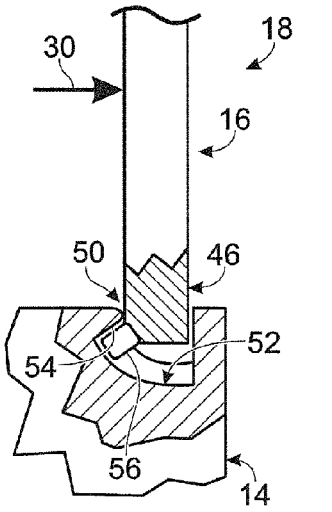
FIG. 6 is another diagram, partially in cross-section, schematically representing illustrative, non-exclusive examples of coupling structures of hinged assemblies according to the present disclosure.

An example of such structure is schematically illustrated in FIG. 3, in which the base member defines a sleeve 80, within which axle 46 is received and is permitted to pivot. The sleeve may define one or more slots 52 having inner edges 54. The axle may include one or more corresponding tabs 56 that extend through the one or more slots. When the hinged member is in its fully open position, the tabs engage the inner edges of the slots, thereby defining the fully open position of the hinged member. That is, the engagement between the tabs and the inner edges of the slots restrict further pivoting of the hinged member in the opening direction and thereby defines the fully open position. This is schematically illustrated in FIG. 6, with the hinged member being illustrated in its fully open position and with a tab 56 engaged with an inner edge 54 of a slot 52. Accordingly, the opening force 30 is effectively transferred from the hinged member, through the tabs, to the inner edges and thus to the base member, thereby restricting the flexing of the axle. Tabs 56 additionally or alternatively may be described as supporting, bracing, and/or reinforcing the hinged member, or portion thereof to restrict flexing or other deformation thereof responsive to an opening force, while not providing this support, bracing, and/or reinforcement in response to a closing force.

In FIG. 3, two slots and corresponding tabs are illustrated schematically; however, any suitable number of such structure may be included in a hinged assembly, including zero, one, or two or more such structures. Moreover, while in FIGS. 3 and 6, the axle is illustrated as including tabs and the sleeve as defining slots, in some embodiments, the axle may define the slots, while the base member includes the tabs. In some embodiments, the axle may define at least one slot and include at least one tab, while the base member may define at least one slot and include at least one tab, respectively. Other configurations of structure that facilitate the restriction of the flexing of the axle when an opening force is applied against the hinged member in the fully open position also are within the scope of the present disclosure.

Turning now to FIGS. 7-11, an illustrative, non-exclusive example of a children's product 10 in the form of a children's ride-on vehicle 100 is illustrated. Where appropriate, the reference numerals from the schematic illustrations of FIGS. 1-6 are used to designate corresponding parts of children's ride-on vehicle 100; however, the example of FIGS. 7-11 is non-exclusive and does not limit children's products 10 and corresponding hinged assemblies 12 to the illustrated embodiment of a children's product 10. That is, neither children's products 10 nor hinged assemblies 12 are limited to the specific embodiment of the illustrated children's ride-on vehicle 100, and children's products 10 and associated hinged assemblies 12 may incorporate any number of the various aspects, configurations, characteristics, properties, etc. of children's products 10 or hinged assemblies 12 that are illustrated in and discussed with reference to the schematic representations of FIGS. 1-6 and/or the embodiment of FIGS. 7-11, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to children's ride-on vehicle 100; however, it is within the scope of the present disclosure that the previously discussed features, variants, etc. may be utilized with children's ride-on vehicle 100.

Figure 7:
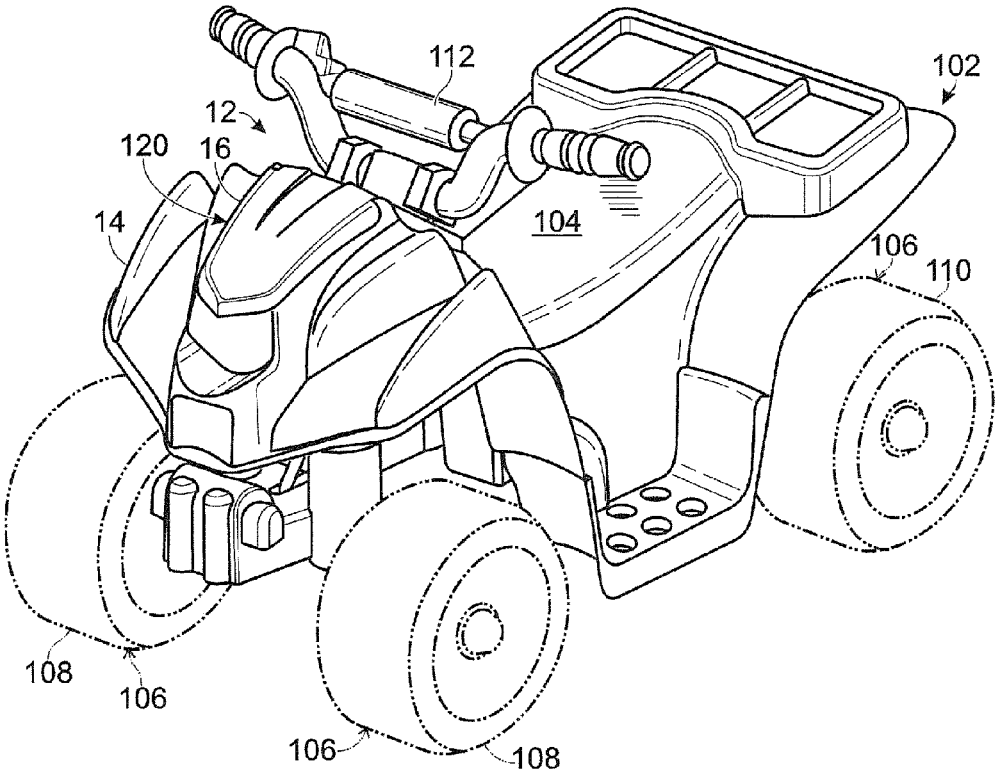
FIG. 7 is an isometric view of an illustrative, non-exclusive example of a children's ride-on vehicle according to the present disclosure.

Children's ride-on vehicle 100 is an illustrative, non-exclusive example of a children's ride-on vehicle in the form of a four-wheeled vehicle that is configured to resemble an all-terrain vehicle, or ATV, which additionally or alternatively may be referred to as a four-wheeler. With reference to FIG. 7, children's ride-on vehicle 100 includes a support frame, or body, 102, a child-sized seat 104 that is sized and configured to accommodate at least one child (including a child driver), a plurality of wheels 106 including a pair of steerable wheels 108 and a pair of rear wheels 110, and a steering assembly 112 in the form of a handlebar assembly, with the steering assembly being operatively coupled to the steerable wheels. In some embodiments, as discussed herein, children's ride-on vehicles according to the present disclosure, including children's ride-on vehicle 100, may include a battery-powered drive system, including at least one motor, in which case the plurality of wheels may include at least one driven wheel, which in some embodiments may be the rear wheels 110. As used herein, the term "driven wheel" refers to a wheel that is rotated directly in response to a rotational input from the drive assembly.

While children's ride-on vehicle 100 includes four wheels, including two steerable wheels and two rear wheels, which also may be driven wheels, any suitable number of wheels may be included as part of a children's ride-on vehicle according to the present disclosure, including two, three, four, or more than four wheels. Moreover, children's ride-on vehicles according to the present disclosure may be shaped to generally resemble any type of vehicle, including reduced-scale, or child-sized, vehicles that are shaped to resemble corresponding full-sized, or adult-sized, vehicles, such as cars, trucks, construction vehicles, emergency vehicles, off-road vehicles, motorcycles, space vehicles, aircraft, watercraft and the like, as well as vehicles that are shaped to resemble fantasy vehicles that do not have a corresponding adult-sized counterpart. Although children's ride-on vehicle 100 is depicted in the form of a four-wheeled all terrain vehicle, the components and/or features of children's ride-on vehicle 100 may be configured for use on and/or with any type of children's ride-on vehicle.

Body 102 typically is formed (at least substantially, if not completely) from molded plastic and may be integrally formed or formed from a plurality of parts that are secured together by screws, bolts, clips, or other suitable fasteners. The body may additionally or alternatively be formed at least partially from other suitable material(s), such as metal, wood, or composite materials. The body may include an underlying frame, or chassis, on which an upper body is mounted. In such an embodiment, the frame is often formed of metal and/or molded plastic, with the upper body formed of molded plastic.

As mentioned, children's ride-on vehicle 100 is an example of children's product 10, and therefore includes a hinged assembly 12. Specifically, children's ride-on vehicle 100 includes a hinged assembly that is defined by body 102 and a hood 120. Accordingly, the body defines base member 14, and the hood defines hinged member 16 of the hinged assembly. Moreover, as seen in FIG. 8, body 102 further defines a cavity 20, which is selectively opened and closed by a child by selectively pivoting the hood relative to the cavity.

Figure 8:
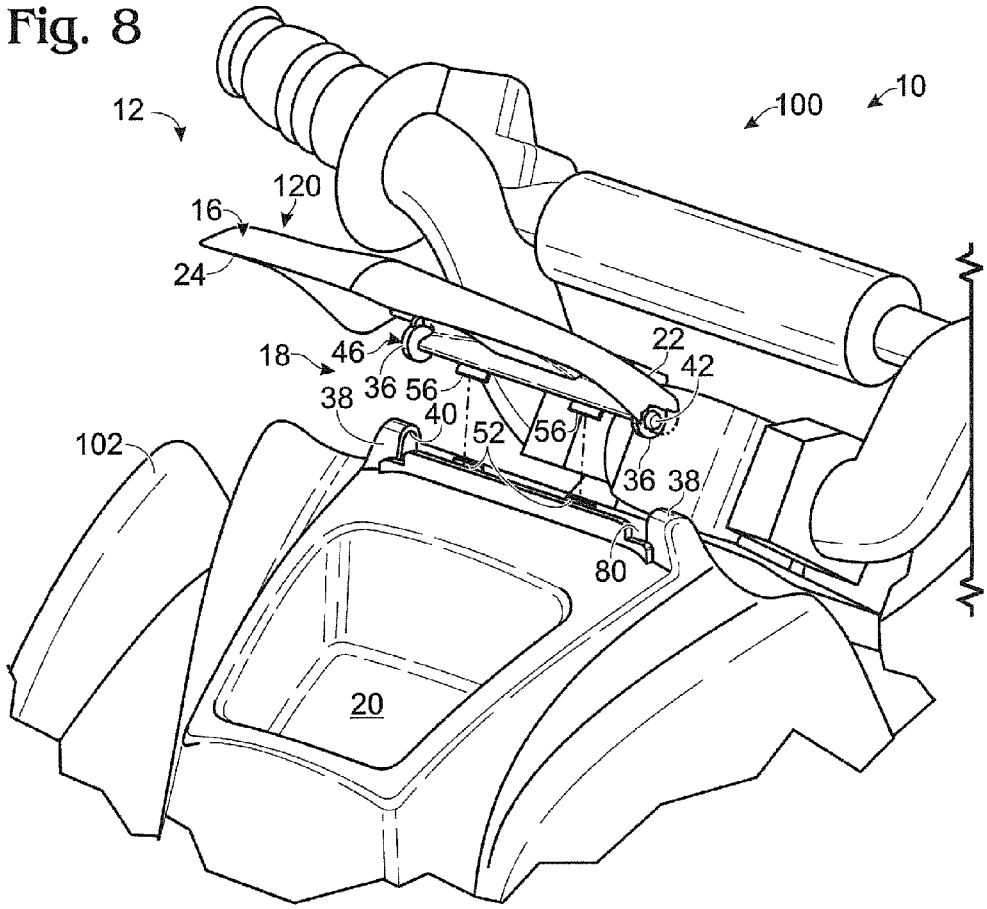
FIG. 8 is an isometric exploded view of a portion of a hinged assembly of the children's ride-on vehicle of FIG. 7.

As seen in FIG. 8, hood 120 includes an axle 46 with opposed hinged-member end-regions 36 having protrusions 42 and with a pair of tabs 56. Body 102 defines a sleeve 80, within which the axle of the hood is selectively positioned and pivoted. Moreover, body 102 includes opposed base-member hinge-regions 38 that define sockets 40 that are configured to selectively receive and mate with the protrusions of the hood, and slots 52 that are configured to receive the tabs of the axle of the hood. Accordingly, the hinged assembly 12 of children's ride-on vehicle 100 is an example of a hinged assembly that defines a hinge 18 that is configured both (i) to release when an obstruction is positioned between the hood and the body while the hood is being closed with a closing torque greater than a release torque and (ii) to not release when the hood is being opened with an opening torque that is less than a maximum opening torque.

Figure 9:
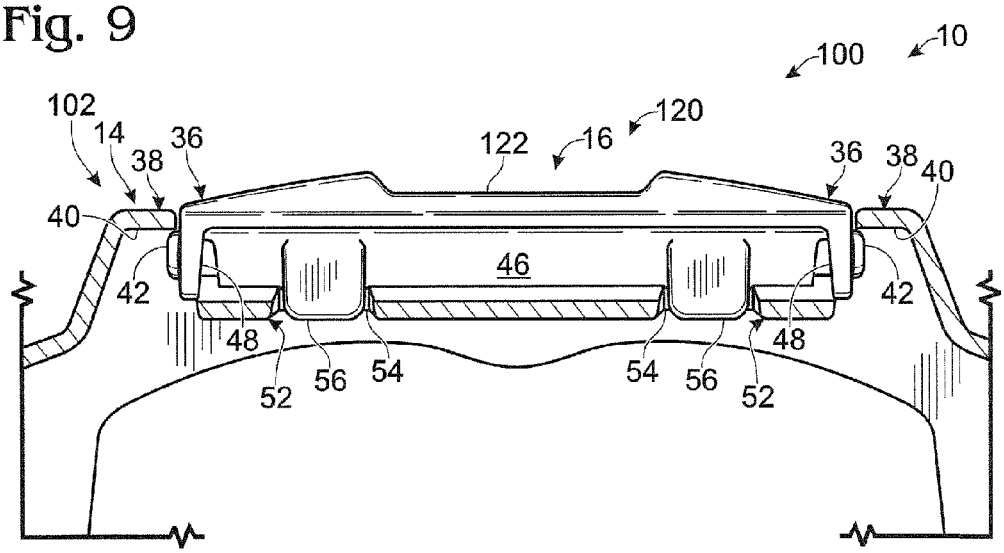
FIG. 9 is a partial cross-sectional rear view of a portion of the hinged assembly of the children's ride-on vehicle of FIG. 7.

As seen in FIG. 9, the axle 46 of hood 120 includes two voids 48 positioned toward the opposed hinged-member end-regions 36. Accordingly, when an obstacle obstructs the closing of the hood and when the corresponding closing torque is greater than the release torque associated with the hood, one or both of the end-regions 36 will pivot, or bend, relative to the remainder of the axle, thereby causing the protrusions 42 to disengage from the sockets and thus causing the hinge to release. More specifically with reference to FIG. 9, a closing torque may cause a central region 122 of the axle to raise, which in turn causes the protrusions to engage and transfer the force to the underside of the top of the sockets. When the closing torque is greater than the release torque, at least one of the opposed hinge-member end regions will begin to pivot inward, thereby causing the corresponding protrusion to disengage from the underside of the top of the corresponding socket.

Figure 10:
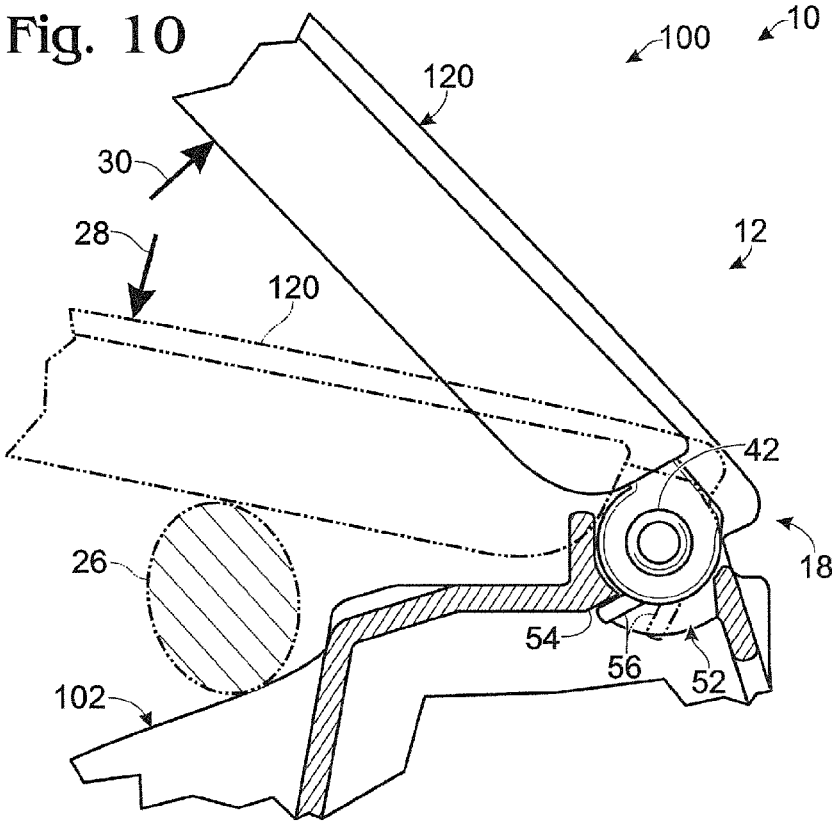
FIG. 10 is a partial cross-sectional side view of a portion of the hinged assembly of the children's ride-on vehicle of FIG. 7.

FIG. 10 illustrates the functionality of the hinged member of children's ride-on vehicle 100 that is associated with the maintaining of engagement between hood 120 and body 102 when an applied opening force 30 creates an opening torque that is less than a maximum opening torque. Specifically, hood 120 is illustrated in solid lines in its fully open position, with one of its two tabs 56 engaged with inside edge 54 of slot 52. Accordingly, the opening force is transferred from the hood, through the tabs, to the body of the children's ride-on vehicle, thereby restricting the flexing of the hood and thus restricting the release of the hinge.

FIG. 10 also illustrates, in dash-dot-dot lines, the hood in a position toward its closed position, relative to the fully open position, and with an obstacle 26 obstructing the closing of the hood.

Figure 11:
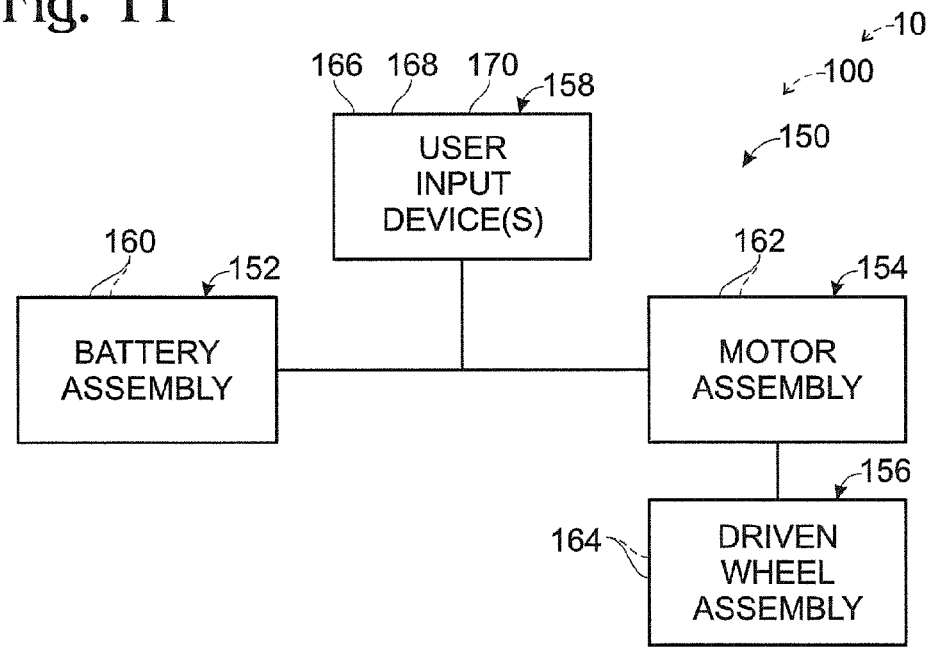
FIG. 11 is a diagram schematically representing battery-powered children's ride-on vehicles, which may include one or more hinged assemblies according to the present disclosure.

Children's ride-on vehicles according to the present disclosure, including children's ride-on vehicle 100, may be (but are not required to be) powered vehicles. FIG. 11 is a diagram schematically representing optional drive assemblies 150 of children's ride-on vehicles, which optionally may include children's ride-on vehicle 100, and which may be a children's product 10. As schematically represented, a drive assembly may include battery assembly 152, a motor assembly 154 electrically coupled to the battery assembly, a driven wheel assembly 156 coupled to the motor assembly, and one or more user input devices 158.

Battery assembly 152 may include one or more batteries 160 that are adapted to provide power to the motor assembly. The one or more batteries in the battery assembly may have any suitable construction, and in some embodiments may be rechargeable batteries.

Motor assembly 154 includes one or more battery-powered motors 162 that are adapted to drive the rotation of at least one wheel of the driven wheel assembly, which may include one or more driven wheels 164, depending on the configuration of the children's ride-on vehicle.

User input device(s) 158 are adapted to convey inputs from a child seated on the children's ride-on vehicle to the drive assembly. That is, the input device(s) are configured to convey a user's inputs, such as via a wiring harness, to control the actuation of motor assembly 154, such as by causing the actuation (or energizing) of the motor assembly, selecting between a range of electronic configurations, selecting the direction of rotation of the motor assembly's output, selecting the relative degree to which the motor assembly is actuated, etc. An example of a suitable user input device 158 includes (but is not limited to) a drive actuator 166, through which a user input directing battery assembly 152 to energize the motor assembly is received. Examples of suitable drive actuators include an on/off switch, a foot pedal, a throttle lever, and a rotational handgrip on a steering mechanism that includes a handlebar. Other illustrative, non-exclusive examples of user input devices include a speed switch 168, which enables a user to select the relative rate of rotation of the motor assembly's output, and a direction switch 170, which enables a user to select the relative direction or rotation of the motor assembly and thereby selectively configure the children's ride-on vehicle to drive in a forward or reverse directions. When present, the speed switch and the direction switch may be located in any suitable location on the body or steering assembly of the children's ride-on vehicle for actuation by a child seated on the seat of the children's ride-on vehicle.

Illustrative, non-exclusive examples of hinged assemblies, and toy products containing at least one hinged assembly, according to the present disclosure are described in the following enumerated paragraphs.

A A hinged assembly, comprising:

a base member; and a hinged member, the hinged member including:

a proximal end region operatively coupled to the base member in a pivotal relationship; and a distal end region opposite the proximal end region;

wherein the base member and the hinged member collectively define a hinge;

wherein the hinged member is selectively pivotal relative to the base member in a range of positions that include a closed position, in which the distal end region is adjacent to the base member, and an open position, in which the distal end region is spaced farther away from the base member than when the hinged member is in the closed position; and wherein the hinge is configured so that if an obstacle is placed between the hinged member and the base member when the hinged member is being moved in a closing direction from the open position toward the closed position by a closing force, the proximal end region of the hinged member will disengage from the base member if the closing force creates a closing torque that is greater than or equal to a release torque.

A1 The hinged assembly of paragraph A, wherein the hinge is configured so that if an opening force is applied against the hinged member in an opening direction away from the closed position when the hinged member is in the open position to create an opening torque, the proximal end region of the hinged member will not disengage from the base member when the opening torque is less than or equal to a maximum opening torque, wherein the maximum opening torque is greater than the release torque.

A1.1 The hinged assembly of paragraph A1, wherein the maximum opening torque is substantially greater than the release torque.

A1.2 The hinged assembly of any of paragraphs A1-A1.1, wherein the maximum opening torque is at least twice as great as the release torque.

A1.3 The hinged assembly of any of paragraphs A1-A1.1, wherein the maximum opening torque is at least five times as great as the release torque.

A1.4 The hinged assembly of any of paragraphs A1-A1.1, wherein the maximum opening torque is at least ten times as great as the release torque.

A2 The hinged assembly of any of paragraphs A-A1.4, wherein the hinge is configured so that if an obstacle is placed between the hinged member and the base member when the hinged member is being moved in the closing direction by the closing force, the proximal end region of the hinged member will disengage from the base member without damaging either of the hinged member or the base member if the closing torque is greater than or equal to the release torque.

A3 The hinged assembly of any of paragraphs A-A2, wherein the hinged member and the base member are configured to be repeatedly disengaged from each other and reengaged with each other to define the hinge without damage to the hinged member or the base member.

A4 The hinged assembly of any of paragraphs A-A3, wherein the hinged member includes a pair of opposed hinged-member end-regions;

wherein the base member includes a pair of opposed base-member hinge-regions configured to selectively mate with the opposed hinged-member end-regions;

wherein the opposed hinged-member end-regions and the opposed base-member hinge-regions collectively define an axis about which the hinged member is pivotal relative to the base member; and wherein the hinged member has a hinged-member flexibility that operatively permits the opposed hinged-member end-regions to disengage from the opposed base-member hinge-regions when the closing torque is greater than or equal to the release torque when the hinged member is being moved in the closing direction and when an obstacle is placed between the hinged member and the base member.

A4.1 The hinged assembly of paragraph A4, wherein the opposed hinged-member end-regions each include a protrusion, and wherein the opposed base-member hinge-regions each include a socket configured to selectively mate with a respective protrusion.

A4.2 The hinged assembly of paragraph A4, wherein the opposed hinged-member end-regions each include a socket, and wherein the opposed base-member hinge-regions each include a protrusion configured to selectively mate with a respective socket.

A4.3 The hinged assembly of any of paragraphs A4-A4.2, wherein the hinged member includes an axle that includes the proximal end region and the opposed hinged-member end-regions and that extends between the opposed base-member hinge-regions; and wherein the axle has an axle flexibility that operatively permits the opposed hinged-member end-regions to disengage from the opposed base-member hinge-regions when the closing torque is greater than or equal to the release torque when the hinged member is being moved in the closing direction and when an obstacle is placed between the hinged member and the base member.

A4.3.1 The hinged assembly of paragraph A4.3, wherein the hinged member further includes a body that includes the distal end region; and wherein the axle and the body collectively define the hinged-member flexibility that operatively permits the opposed hinged-member end-regions to disengage from the opposed base-member hinge-regions when the closing torque is greater than or equal to the release torque when the hinged member is being moved in the closing direction and when an obstacle is placed between the hinged member and the base member.

A4.3.2 The hinged assembly of any of paragraphs A4.3-A4.3.1, wherein the axle defines at least one void region between the opposed hinged-member end-regions and that at least partially facilitates the axle flexibility.

A4.3.3 The hinged assembly of any of paragraphs A4.3-A4.3.2, wherein the axle defines a generally hollow open cylinder.

A4.3.4 The hinged assembly of any of paragraphs A4.3-A4.3.3 when depending from paragraph A1, wherein the base member defines a sleeve between the opposed base-member hinge-regions and within which the axle is at least partially positioned and pivots when the hinged member is moved between the open position and the closed position;

wherein one of the sleeve and the axle defines at least one slot, the at least one slot having an inner edge; and wherein the other one of the sleeve and the axle includes at least one tab that extends through the at least one slot, and wherein when the hinged member is in the open position, the at least one tab is engaged with the inner edge of the at least one slot so that the opening force is transferred from the hinged member to the base member via the at least one tab and the inner edge of the at least one slot, thereby restricting disengagement of the hinged member from the base member when the opening torque is less than or equal to the maximum opening torque.

A4.3.4.1 The hinged assembly of paragraph A4.3.4, wherein when the hinged member is in the open position and the opening torque is less than or equal to the maximum opening torque, the engagement between the at least one tab and the inner edge of the at least one slot restricts flexing of the hinged member.

A4.3.4.2 The hinged assembly of any of paragraphs A4.3.4-A4.3.4.1, wherein when the hinged member is in the open position and the opening torque is less than or equal to the maximum opening torque, the engagement between the at least one tab and the inner edge of the at least one slot restricts flexing of the axle.

A4.3.4.3 The hinged assembly of any of paragraphs A4.3.4-A4.3.4.2, wherein one of the sleeve and the axle defines two slots with each slot having an inner edge; and wherein the other one of the sleeve and the axle includes two tabs, wherein each tab extends through a respective one of the two slots, and wherein when the hinged member is in the open position, each tab is engaged with the respective inner edge of the respective slot.

A4.4 The hinged assembly of any of paragraphs A-A4.3.4.3 when depending from paragraph A1, wherein the hinged member includes an axle that defines an axis about which the hinged member is pivotal relative to the base member;

wherein the base member defines a sleeve within which the axle is at least partially positioned and pivots when the hinged member is moved between the open position and the closed position;

wherein one of the sleeve and the axle defines at least one slot, the at least one slot having an inner edge; and wherein the other of the sleeve and the axle includes at least one tab that extends through the at least one slot, and wherein when the hinged member is in the open position, the at least one tab is engaged with the inner edge of the at least one slot so that the opening force is transferred from the hinged member to the base member via the at least one tab and the inner edge of the at least one slot, thereby restricting disengagement of the hinged member from the base member when the opening torque is less than or equal to the maximum opening torque.

A4.4.1 The hinged assembly of paragraph A4.4, wherein one of the sleeve and the axle defines two slots with each slot having an inner edge; and wherein the other of the sleeve and the axle includes two tabs, wherein each tab extends through a respective one of the two slots, and wherein when the hinged member is in the open position, each tab is engaged with the respective inner edge of the respective slot.

A5 The hinged assembly of any of paragraphs A-A4.4.1, wherein the release torque is greater when the hinged member is toward the open position than when the hinged member is toward the closed position.

A5.1 The hinged assembly of paragraph A5, wherein the release torque is greater when the hinged member is greater than 30 degrees from the closed position than when the hinged member is within 30 degrees from the closed position.

A5.2 The hinged assembly of any of paragraphs A5-A5.1, wherein one of the hinged member and the base member includes a pair of opposed protrusions and the other of the hinged member and the base member includes a pair of opposed sockets that receive the pair of opposed protrusions; and wherein the protrusions and sockets are configured to facilitate the release torque being greater when the hinged member is toward the open position than when the hinged member is toward the closed position.

A5.2.1 The hinged assembly of paragraph A5.2, wherein each of the pair of opposed protrusions includes a chamfer that extends less than an entire circumference around the protrusions, and wherein each of the pair of opposed sockets includes structure associated with the chamfer so that the release torque is greater when the hinged member is toward the open position than when the hinged member is toward the closed position.

A6 The hinged assembly of any of paragraphs A-A5.2.1, wherein the hinge is configured so that the proximal end region of the hinged member will disengage from the base member if the closing torque is greater than or equal to the release torque and if the obstacle defines a dimension between the hinged member and the base member that is in the range of 5-60 mm.

A7 A hinged assembly, comprising:

a base member; and a hinged member, the hinged member including:

a proximal end region operatively coupled to the base member in a pivotal relationship; and a distal end region opposite the proximal end region;

wherein the hinged member is selectively pivotal relative to the base member in a range of positions including a closed position, in which the distal end region is adjacent to the base member, and an open position, in which the distal end region is spaced farther away from the base member than when the hinged member is in the closed position; and wherein the base member and the hinged member collectively define means for disengaging the proximal end region from the base member when an obstacle is placed between the hinged member and the base member and when the hinged member is being moved in a closing direction from the open position toward the closed position by a closing force to create a closing torque that is greater than or equal to a release torque.

A7.1 The hinged assembly of paragraph A7, wherein the base member and the hinged member further collectively define means for maintaining the proximal end region in engagement with the base member when an opening force is applied against the hinged member in an opening direction away from the closed position and when the hinged member is in the open position to create an opening torque that is less than or equal to a maximum opening torque, and wherein the maximum opening torque is greater than the release torque.

A7.2 The hinged assembly of any of paragraphs A7-A7.1, further comprising the structure and/or functionality of any of paragraphs A-A6.

A8 A hinged assembly, comprising:

a base member, wherein the base member includes opposing sockets and defines a sleeve between the opposing sockets and at least one slot having an inner edge; and a hinged member, the hinged member including:

a proximal end region operatively coupled to the base member in a pivotal relationship, wherein the proximal end region includes an axle that defines an axis about which the hinged member is pivotal relative to the base member, wherein the axle is positioned within the sleeve and includes end regions configured to mate with the opposing sockets of the base member, wherein the axle further includes at least one tab that extends through the at least one slot; and a distal end region opposite the proximal end region;

wherein the hinged member is selectively pivotal relative to the base member in a range of positions including a closed position, in which the distal end region is adjacent to the base member, and an open position, in which the distal end region is spaced farther away from the base member than when the hinged member is in the closed position;

wherein the axle has a flexibility that operatively permits the end regions to disengage from the opposing sockets when an obstacle is placed between the hinged member and the base member when the hinged member is being moved in a closing direction from the open position toward the closed position by a closing force to create a closing torque that is greater than or equal to a release torque; and wherein when the hinged member is in the open position and when an opening force is applied against the hinged member in an opening direction away from the closed position to create an opening torque that is less than or equal to a maximum opening torque, the at least one tab engages the inner edge of the at least one slot and restricts disengagement between the proximal end region of the base member and the hinged member, wherein the maximum opening torque is substantially greater than the release torque.

A8.1 The hinged assembly of paragraph A8, further comprising the structure and/or functionality of any of paragraphs A-A7.2.

A9 A hinged assembly, comprising:

a base member; and a hinged member operatively and pivotally coupled to the base member to define a hinge;

wherein the hinge is configured so that if an obstacle is positioned between the hinged member and the base member while the hinged member is being closed, the hinged member will disengage from the base member to prevent pinching of the obstacle.

A9.1 The hinged assembly of paragraph A9, wherein the hinge is further configured so that when the hinged member is being opened, the hinged member will not disengage from the base member if an opening torque is less than or equal to a maximum opening torque.

A9.2 The hinged assembly of any of paragraphs A9-A9.1, further comprising the structure and/or functionality of any of paragraphs A-A8.1.

A10 A hinged assembly, comprising:

a base member; and a hinged member operatively and pivotally coupled to the base member to define a hinge, wherein the hinge defines a range of pivotal positions of the hinged member relative to the base member, with the range of pivotal positions including a closed position and a fully open position;

wherein the hinge is configured so that if an obstacle is positioned in engagement between the hinged member and the base member while the hinged member is being urged toward the closed position by a closing force that defines a closing torque that is at least as great as a release torque, the hinge will release to detach the hinged member from the base member to prevent pinching of the obstacle; and wherein the hinge is further configured so that the hinge will not detach the hinged member from the base member when the hinged member is being urged toward or is opened to the fully open position by an opening force that creates an opening torque that is greater than the release torque and less than or equal to a maximum opening torque.

A10.1. The hinged assembly of paragraph A10, wherein the hinge is further configured so that it will detach the hinged member from the base member to prevent pinching of the obstacle when the obstacle is positioned in engagement between the hinged member and the base member while the hinged member is being urged toward the closed position by the closing force and when the obstacle defines a dimension between the hinged member and the base member that is in the range of 5-60 mm.

A10.2 The hinged assembly of any of paragraphs A10-A10.1, further comprising the structure and/or functionality of any of paragraphs A-A9.2.

A11 The use of the hinged assembly of any of paragraphs A-A10.2.

A12 A children's ride-on vehicle, comprising:

a vehicle body including a seat sized for a child;

a plurality of wheels operatively coupled to the vehicle body; and the hinged assembly of any of paragraphs A-A10.2.

A12.1 The children's ride-on vehicle of paragraph A12, further comprising:

at least one of a hood, a door, a trunk closure, a seat, a battery cover, or a compartment closure;

wherein the at least one of a hood, a door, a trunk closure, a seat, a battery cover, or a compartment closure includes the hinged member, and the vehicle body includes the base member.

A12.2 The use of the children's ride-on vehicle of any of paragraphs A12-A12.1.

A13 A children's product, comprising:

a product body;

a closure; and the hinged assembly of any of paragraphs A-A10.2;

wherein the closure includes the hinged member, and the product body includes the base member.

A13.1 The children's product of paragraph A13, wherein the product body defines a cavity and wherein the hinged member at least partially covers the cavity when the hinged member is in the closed position and at least partially uncovers the cavity when the hinged member is in the open position.

A13.2 The use of the children's product of any of paragraphs A13-A13.1.

As used herein, "selective" and "selectively," when modifying an action, movement, configuration, or other activity of one or more components or characteristics of a hinged assembly 12 or children's product 10, mean that the specific action, movement, configuration, or other activity is a direct or indirect result of user manipulation of an aspect of, or one or more components of, the hinged assembly and/or children's product.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply capable of performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

The disclosure set forth above encompasses multiple distinct inventions with independent utility. While each of these inventions has been disclosed in its preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods, and/or steps disclosed herein. Similarly, where any disclosure above or claim below recites "a" or "a first" element, step of a method, or the equivalent thereof, such disclosure or claim should be understood to include incorporation of one or more such elements or steps, neither requiring nor excluding two or more such elements or steps.

It is believed that the following claims particularly point out certain combinations and subcombinations that are directed to one of the disclosed inventions and are novel and non-obvious. Inventions embodied in other combinations and subcombinations of features, functions, elements, properties, methods, and/or steps may be claimed through amendment of the present claims or presentation of new claims in this or a related application. Such amended or new claims, whether they are directed to a different invention or directed to the same invention, whether different, broader, narrower, or equal in scope to the original claims, also are regarded as within the subject matter of the inventions of the present disclosure.

The invention claimed is:

1. A hinged assembly, comprising:

a base member; and a hinged member operatively and pivotally coupled to the base member to define a hinge, wherein the hinge defines a range of pivotal positions of the hinged member relative to the base member, with the range of pivotal positions including a closed position and a fully open position;

wherein the hinge is configured so that if a child's finger is positioned in engagement between the hinged member and the base member while the hinged member is being urged toward the closed position by a closing force that defines a closing torque that is at least as great as a release torque, the hinge will release to detach the hinged member from the base member to prevent pinching of the child's finger; and wherein the hinge is further configured so that the hinge will not detach the hinged member from the base member when the hinged member is being urged toward or is opened to the fully open position by an opening force that creates an opening torque that is greater than the release torque and less than or equal to a maximum opening torque.

2. The hinged assembly of claim 1, wherein the hinge is further configured so that it will detach the hinged member from the base member to prevent pinching of the child's finger when the child's finger is positioned in engagement between the hinged member and the base member while the hinged member is being urged toward the closed position by the closing force and when the child's finger defines a dimension between the hinged member and the base member that is in the range of 5-60 mm.

3. A children's product, comprising:

a product body;

a closure; and the hinged assembly of claim 1;

wherein the closure includes the hinged member, and the product body includes the base member.

4. The children's product of claim 3, wherein the product body defines a cavity and wherein the hinged member at least partially covers the cavity when the hinged member is in the closed position and at least partially uncovers the cavity when the hinged member is in the open position.

5. A hinged assembly, comprising:

a base member; and a hinged member, the hinged member including:

a proximal end region operatively coupled to the base member in a pivotal relationship; and a distal end region opposite the proximal end region;

wherein the base member and the hinged member collectively define a hinge;

wherein the hinged member is selectively pivotal relative to the base member in a range of positions that include a closed position, in which the distal end region is adjacent to the base member, and an open position, in which the distal end region is spaced farther away from the base member than when the hinged member is in the closed position;

wherein the hinge is configured so that if a child's finger is placed between the hinged member and the base member when the hinged member is being moved in a closing direction from the open position toward the closed position by a closing force, the proximal end region of the hinged member will decouple from the base member if the closing force creates a closing torque that is greater than or equal to a release torque; and wherein the hinge is configured so that if an opening force is applied against the hinged member in an opening direction away from the closed position when the hinged member is in the open position to create an opening torque, the proximal end region of the hinged member will not decouple from the base member when the opening torque is less than or equal to a maximum opening torque, wherein the maximum opening torque is greater than the release torque.

6. The hinged assembly of claim 5, wherein the maximum opening torque is at least twice as great as the release torque.

7. The hinged assembly of claim 5, wherein the hinge is configured so that if a child's finger is placed between the hinged member and the base member when the hinged member is being moved in the closing direction by the closing force, the proximal end region of the hinged member will decouple from the base member without damaging either of the hinged member or the base member if the closing torque is greater than or equal to the release torque.

8. The hinged assembly of claim 5, wherein the hinged member and the base member are configured to be repeatedly decoupled from each other and recoupled to each other to define the hinge without damage to the hinged member or the base member.

9. The hinged assembly of claim 5, wherein the hinged member includes a pair of opposed hinged-member end-regions;

wherein the base member includes a pair of opposed base-member hinge-regions configured to selectively mate with the opposed hinged-member end-regions;

wherein the opposed hinged-member end-regions and the opposed base-member hinge-regions collectively define an axis about which the hinged member is pivotal relative to the base member; and wherein the hinged member has a hinged-member flexibility that operatively permits the opposed hinged-member end-regions to disengage from the opposed base-member hinge-regions when the closing torque is greater than or equal to the release torque when the hinged member is being moved in the closing direction and when a child's finger is placed between the hinged member and the base member.

10. The hinged assembly of claim 9, wherein the hinged member includes an axle that includes the proximal end region and the opposed hinged-member end-regions and that extends between the opposed base-member hinge-regions;

wherein the axle has an axle flexibility that operatively permits the opposed hinged-member end-regions to disengage from the opposed base-member hinge-regions when the closing torque is greater than or equal to the release torque when the hinged member is being moved in the closing direction and when a child's finger is placed between the hinged member and the base member; and wherein the axle defines at least one void region between the opposed hinged-member end-regions and that at least partially facilitates the axle flexibility.

11. The hinged assembly of claim 10, wherein the base member defines a sleeve between the opposed base-member hinge-regions and within which the axle is at least partially positioned and pivots when the hinged member is moved between the open position and the closed position;

wherein one of the sleeve and the axle defines at least one slot, the at least one slot having an inner edge; and wherein the other one of the sleeve and the axle includes at least one tab that extends through the at least one slot, and wherein when the hinged member is in the open position, the at least one tab is engaged with the inner edge of the at least one slot so that the opening force is transferred from the hinged member to the base member via the at least one tab and the inner edge of the at least one slot, thereby restricting decoupling of the hinged member from the base member when the opening torque is less than or equal to the maximum opening torque.

12. The hinged assembly of claim 11, wherein when the hinged member is in the open position and the opening torque is less than or equal to the maximum opening torque, the engagement between the at least one tab and the inner edge of the at least one slot restricts flexing of the axle.

13. The hinged member of claim 5, wherein the release torque is greater when the hinged member is toward the open position than when the hinged member is toward the closed position.

14. The hinged assembly of claim 5, wherein the hinged member includes an axle that defines an axis about which the hinged member is pivotal relative to the base member;

wherein the base member defines a sleeve within which the axle is at least partially positioned and pivots when the hinged member is moved between the open position and the closed position;

wherein one of the sleeve and the axle defines at least one slot, the at least one slot having an inner edge; and wherein the other of the sleeve and the axle includes at least one tab that extends through the at least one slot, and wherein when the hinged member is in the open position, the at least one tab is engaged with the inner edge of the at least one slot so that the opening force is transferred from the hinged member to the base member via the at least one tab and the inner edge of the at least one slot, thereby restricting decoupling of the hinged member from the base member when the opening torque is less than or equal to the maximum opening torque.

15. A children's ride-on vehicle, comprising:

a vehicle body including a seat sized for a child;

a plurality of wheels operatively coupled to the vehicle body; and the hinged assembly of claim 5.

16. The children's ride-on vehicle of claim 15, further comprising:

at least one of a hood, a door, a trunk closure, a seat, a battery cover, or a compartment closure, wherein the at least one of a hood, a door, a trunk closure, a seat, a battery cover, or a compartment closure includes the hinged member and the vehicle body includes the base member.

17. A children's product, comprising:

a product body;

a closure; and the hinged assembly of claim 5;

wherein the closure includes the hinged member and the product body includes the base member.

18. The children's product of claim 17, wherein the product body defines a cavity and wherein the hinged member at least partially covers the cavity when the hinged member is in the closed position and at least partially uncovers the cavity when the hinged member is in the open position.

19. A hinged assembly, comprising:

a base member; and a hinged member, the hinged member including:

a proximal end region operatively coupled to the base member in a pivotal relationship; and a distal end region opposite the proximal end region;

wherein the hinged member is selectively pivotal relative to the base member in a range of positions including a closed position, in which the distal end region is adjacent to the base member, and an open position, in which the distal end region is spaced farther away from the base member than when the hinged member is in the closed position; and wherein the base member and the hinged member collectively define means for decoupling the proximal end region from the base member when a child's finger is placed between the hinged member and the base member and when the hinged member is being moved in a closing direction from the open position toward the closed position by a closing force to create a closing torque that is greater than or equal to a release torque.

20. The hinged assembly of claim 19, wherein the base member and the hinged member further collectively define means for maintaining the proximal end region in engagement with the base member when an opening force is applied against the hinged member in an opening direction away from the closed position and when the hinged member is in the open position to create an opening torque that is less than or equal to a maximum opening torque, and wherein the maximum opening torque is greater than the release torque.

21. A children's product, comprising:

a product body;

a closure; and the hinged assembly of claim 20;

wherein the closure includes the hinged member and the product body includes the base member; and wherein the product body defines a cavity and wherein the hinged member at least partially covers the cavity when the hinged member is in the closed position and at least partially uncovers the cavity when the hinged member is in the open position.

* * * * *